United States Patent [19]

Bührer

[11] 4,084,709

[45] Apr. 18, 1978

[54] DEVICE FOR LIFTING-LOWERING AND ROTATING OPERATIONS

[76] Inventor: Erwin Bührer, Vogelingasschen 40 8200, Schaffhausen, Switzerland

[21] Appl. No.: 725,115

[22] Filed: Sep. 20, 1976

Related U.S. Application Data

[63] Continuation-in-part of Ser. No. 598,351, Jul. 23, 1975, abandoned.

[30] Foreign Application Priority Data

Jul. 31, 1974 Switzerland ..... 10531/74

[51] Int. Cl.[2] ..... B66C 1/62

[52] U.S. Cl. ..... 214/1 BB; 214/1 BC; 214/151; 214/650 R

[58] Field of Search ..... 214/1 B, 1 BB, 1 BC, 214/151, 6 A, 6 TS, 650 R

[56] References Cited

U.S. PATENT DOCUMENTS

| | | | |
|---|---|---|---|
| 1,537,963 | 5/1925 | O'Neill | 214/1 BB |
| 2,754,555 | 7/1956 | Young | 214/1 BB X |
| 2,773,582 | 12/1956 | Denyssen | 214/1 BC X |
| 2,811,267 | 10/1957 | Bock | 214/151 |
| 3,090,502 | 5/1963 | Gunzelmann | 214/1 BB X |
| 3,107,402 | 10/1963 | Hunter | 214/1 BB X |
| 3,115,974 | 12/1963 | Kovach | 214/1 BC X |
| 3,542,213 | 11/1970 | Gram | 214/1 BB |
| 3,635,323 | 1/1972 | Helfer | 214/1 BC |
| 3,766,617 | 10/1973 | Forster | 214/1 BC X |
| 3,870,164 | 3/1975 | Haase | 214/1 BB |

FOREIGN PATENT DOCUMENTS

| | | | |
|---|---|---|---|
| 1,320,511 | 1/1963 | France | 294/104 |
| 308,042 | 9/1955 | Switzerland | 214/1 BB |
| 318,528 | 2/1957 | Switzerland | 214/1 BB |
| 320,832 | 5/1957 | Switzerland | 214/1 BB |
| 714,361 | 8/1954 | United Kingdom | 214/1 BB |
| 881,497 | 11/1961 | United Kingdom | 214/1 BB |

*Primary Examiner*—Drayton E. Hoffman
*Assistant Examiner*—George F. Abraham
*Attorney, Agent, or Firm*—Toren, McGeady and Stanger

[57] ABSTRACT

In a production operation, such as a molding operation, a device is used for moving both the molded parts produced and molds or similar elements used in the operation, between different working stations. The device includes support frames releasably engageable with the molded parts or elements to be moved and a mechanism supporting the frames. The mechanism extends vertically and can be lifted, lowered and rotated about its vertical axis. The movement of the mechanism is regulated so that the parts or elements being moved can be located in exact position at the working stations without any damage to the mechanism used in the moving operation or to the elements or items being moved.

17 Claims, 19 Drawing Figures

A
143
140
167
142
145
168
69
146
67
34
76
70
33
35
82
81
VI
VI
80
38
74
III
III
49
32
48
44
53
54
43
50
45
31
D
30
51
52

71
72
68
73
39
42
78
195
41
40

70
77
197
115
196
113
107
106
104
105
103
102
117
116
VII
VII
90
101
108
109
100
75
99
110
112
111
94
92
79
91
86
87
95
93
133
97
88
126
114
98
127
68
89
85
96
84
83
131
134
132

DEVICE FOR LIFTING-LOWERING AND ROTATING OPERATIONS

CROSS-REFERENCE TO RELATED APPLICATION

This application is a continuation-in-part of application No. 598,351 filed July 23, 1975 and now abandoned.

BACKGROUND OF THE INVENTION

The present invention is directed to a device for moving items in a production operation, such as in a molding operation, where the device includes a mechanism for moving items to be produced or elements used in the production operation between working stations. The mechanism extends vertically and in addition to rotation about its vertical axis, can be moved upwardly and downwardly in carrying out the moving operations. In particular, the invention is directed to a molding operation for moving mold boxes from a conveyor device to a pattern device and, after the molding operation, moving a molded item from the pattern device to a conveyor.

Molding equipment including a mechanically driven intermittently rotatable turntable which supports at least two pattern devices is known from Swiss Pat. No. 318,528. In such equipment, mechanisms are arranged to be swung-in over the turntable and include controllable elements in operative connection with the turntable. Such mechanisms include elements for engaging mold boxes, for lifting and turning the boxes and, after the boxes have been used, for lifting and removing them.

Of necessity, in such molding equipment, heavy turntables are used which weigh in the range of 15 to 30 tons in the usual case. An extremely powerful rotary drive is required to effect the rapid rotation of the turntable and to effect the the precise positioning of the heavy masses being moved in the different working stations. As a result, a very great backlash is experienced in such equipment. In the molding operation there is the preliminary compression by vibrating or shaking and a final compression by a jolt squeezing operation. These steps are carried out at the same time that the molded parts are being lifted from the pattern device and, as a result, it is not possible without special measures to lift a molded part properly from the pattern device without damaging it. To improve the lifting process, additional brakes have been used which act both on the rotary movement of the turntable and on the elevating and turning mechanisms in the stationary position of the turntable. These brakes are provided to prevent rotary movement during the lifting of a molded part from the pattern device. However, up to the present time, it has not been possible to prevent mutual rotation of the turntable with the elevating and rotating mechanism during the lifting of a molded part from the pattern device to such an extend that a molded part can be lifted without any problems.

Moreover, it has not been possible up to the present to design the elevating and turning mechanism so that the elastic deformation of the lifting piston and the projecting arms which carry the clamps for engaging the molded parts, is kept within narrow limits so that they do not interfere with the lifting of the molded part from the pattern device.

Because of the disadvantages mentioned above, on one hand, the tightening of the patterns does not drop below a certain value and the sharp edges required for a molded part in many molding operations cannot be achieved.

SUMMARY OF THE INVENTION

Therefore, a primary object of the present invention involves the provision of a mechanism for lifting molded parts from a pattern device so that foreign influences such as vibrations for horizontal or tilting movements of the pattern device or the molded part do not interfere with the initial phase of the lifting operation.

Another object of the invention is to perform the lifting step so that the lifting mechanism experiences only fractions of the elastic deformation of the equipment previously used for such operations.

Still another object of the invention is to simplify the equipment required by using a single elevating and turning mechanism instead of two separate mechanisms as used in the past, for depositing mold boxes on the pattern device and for lifting the mold parts from the pattern device.

A further object of the invention is to simplify the molding equipment, making it more economical, by using a single conveyor device for feeding the mold boxes and for removing the molded parts, instead of the two separate conveyor devices which have been used in the past.

In accordance with the present invention, the problems previously experienced are overcome by combining an elevating or lifting mechanism with the turning mechanism. The lifting mechanism supports or carries two oppositely extending members or frames which include control means for releasably engaging mold boxes and molded parts. A controlled drive is operatively connected with the turning or rotating mechanism so that the mechanism can be turned through 180° with controlled acceleration into the working stations of the molding operation. Accordingly, with this equipment, a mold box can be gripped and lifted from a conveyor device by one part of the carrying member while a molded part positioned in a pattern device on a support is gripped and lifted by the other part of the carrying member so that the mold box can be moved to the pattern device and the molded part can be placed on the conveyor device after the turning mechanism has moved through half of a complete turn.

Since, in accordance with the present invention, the pattern device rests on a support independent of the shaking and squeezing devices and of the other moving parts, and because the combined rotating and lifting mechanism has no direct contact with other mechanisms during operation, disturbing influences are avoided which would disadvantageously affect the molding operation.

In accordance with the invention, the means projecting from the carrying member which has control means for engaging the mold boxes or molded parts, is much smaller because it has only to reach over the pattern device and not over a molding machine including a turntable. Furthermore, the moments of force developed by the clamping members used for engaging and lifting the mold boxes and the molded parts cancel each other out to a great extent. Both of these influences provided by the invention reduce the elastic deformation of the lifting and rotating mechanism to fractions of the deformation experienced in previously known devices and, thus, improve the lifting and turning process considerably. In known molding equipment a separate lifting and turning mechanism was required for placing the mold boxes on the pattern device and for lifting the molded parts from the pattern device, however, in the present invention a single lifting and turning mechanism is used. Further, in known molding equipment, two separate conveyor devices were required, one for supplying the mold boxes and another for removing the mold boxes. In the present invention, the supply and removal of the mold boxes and the molded parts are carried out using the same conveyor device.

In automatic molding equipment it is customary to keep the guide dowels of the pattern device and of the mold box short, both for the round guiding dowels and for the flat dowels in the guide, so that canting of the dowel guide during the deposit of a mold box or removal of a molded part can be avoided. Furthermore, it was found that a molded part with a sharp edge can be lifted with known pendulum suspensions on a U-frame carrying the gripping members. However, the present invention affords a similar function for gripping the mold boxes or the molded parts for movement onto or from the pattern device even for sharp-edged molded parts where narrow tolerances are provided for long guide dowels. In the present invention, clamping means are used for gripping and lifting the members to be moved and they are arranged for horizontal movement to the required extend and employ controllable bolts with conical or wedge-shaped ends which can retain the clamping means in a predetermined horizontal position. Therefore, it it possible to use rigidly mounted clamping means secured by the controllable bolts during the gripping, lifting and turning of the mold boxes or molded parts and the clamping means are released only when the mold boxes or the molded parts are finally positioned in the working station to which they are moved as determined in the horizontal direction by the dowel guide of the pattern device.

Molding equipment is known in which molds can be compressed by simultaneous free-fall jarring and squeezing and which use a frame that is attachable to the mold box. To enable the frame to be lifted from or to be deposited on the mold box, additional controllable clamping means can be provided, in accordance with the invention, for releasably engaging the frame to the mold box. This solution has the advantage that frames can be attached to the mold boxes without any special devices which is an excellent expedient for equallizing the compression within the mold.

Another feature of the invention is the ability of the clamping means to lift the frame a given distance off the mold box before the box is engaged. Since there are differences in the height of the mold boxes, due to the fact that these boxes must be ground periodically on their top and bottom sides, it does not cause any difficulty in the lifting of the frame before it is engaged.

In accordance with the present invention, controlled gripping means can be provided for releasably engaging one or a number of parts for placement on or lifting from the pattern device, for example, top sprue patterns, journals for ventilation, and the like. This arrangement replaces the special mechanisms required in known automatic molding equipment using intermittently rotatable turntables.

Still another feature of the invention is the provision of a damper in operative communication with the lifting mechanism which stops both the lifting and lowering movement in predetermined positions with predetermined acceleration. This arrangement has the advantage over solutions used in the past in that the same damper construction can stop both the lifting and lowering movements in certain positions and with a certain acceleration and the damper is constructed to be completely protected against fouling by sand or dust so that it always works reliably.

In accordance with the present invention, the drive for the turning or rotating mechanism includes a crank gear which effects rotation through half of a complete revolution, that is, through 180°, and the gear is connected over a connecting rod to a toothed segment which, in turn, is in meshed engagement with a gear wheel positioned on the turning mechanism. This arrangement has the advantage over the lifting and turning device disclosed in Swiss Pat. No. 318,528 in that the rotary disks for supplying the electrical lines are eliminated. Furthermore, the drive for the turning mechanism can be constructed in a small space without any difficulties so that it is completely protected against contamination and runs in an oil bath. Another feature of the present invention is the provision of elastic means asserting a force in the tangential direction on the turning mechanism when it is in a stationary position and during the complete period when the mechanism is being rotated. In other words, the elastic means acts continuously on the turning mechanism in both of its rotational directions and also when the mechanism is at a standstill. With this arrangement gear clearance is eliminated and, in addition, there is a reduction in the driving movement and also a reduction in the size of the driving gear and the other gear parts.

Another imporvement is the arrangement for retaining the pattern device on the support which prevents the lifting of the pattern device from its support at the start of the lifting process and permits the molded part to be lifted from the pattern device though the device is low in weight and the molded part may be difficult to lift.

Another feature of the invention is the provision of air supply lines connected to the support for the pattern device which provide compressed air, vacuum conditions or atmospheric air to the support. A control valve is positioned in the line connected to the support to provide the desired regulation. With this arrangement there is not only the advantage that the pattern device is firmly retained on the support, but that the support is completely cleaned by a flow of compressed air before the pattern device is attached in each instance.

In another embodiment of the invention a pair of pattern devices are arranged for alternately feeding mold boxes to and for receiving them from a molding machine. A separate lifting and turning mechanism is associated with each pattern device for introducing mold boxes to and for removing them from the pattern device.

The various features of novelty which characterize the invention are pointed out with particularity in the claims annexed to and forming part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
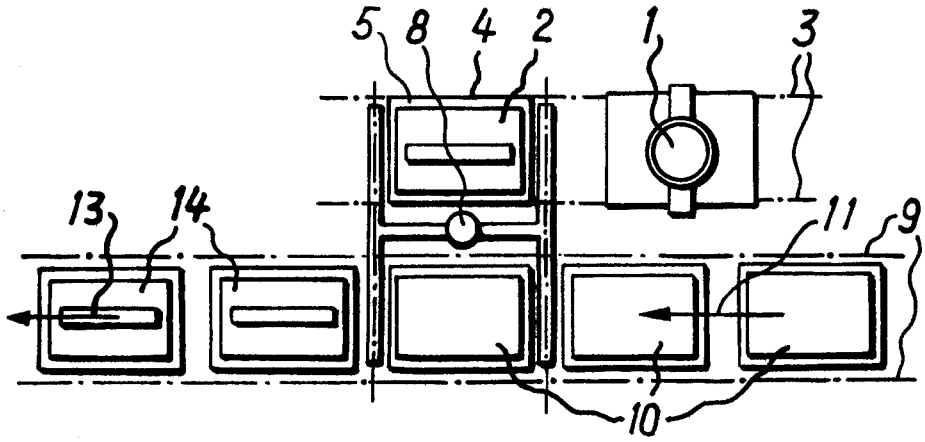
FIG. 1 is a schematic plan view of an equipment set up for molding parts including a lifting and turning mechanism, in accordance with the present invention, and conveyors for supplying and removing mold boxes and molded parts.
Figure 5:
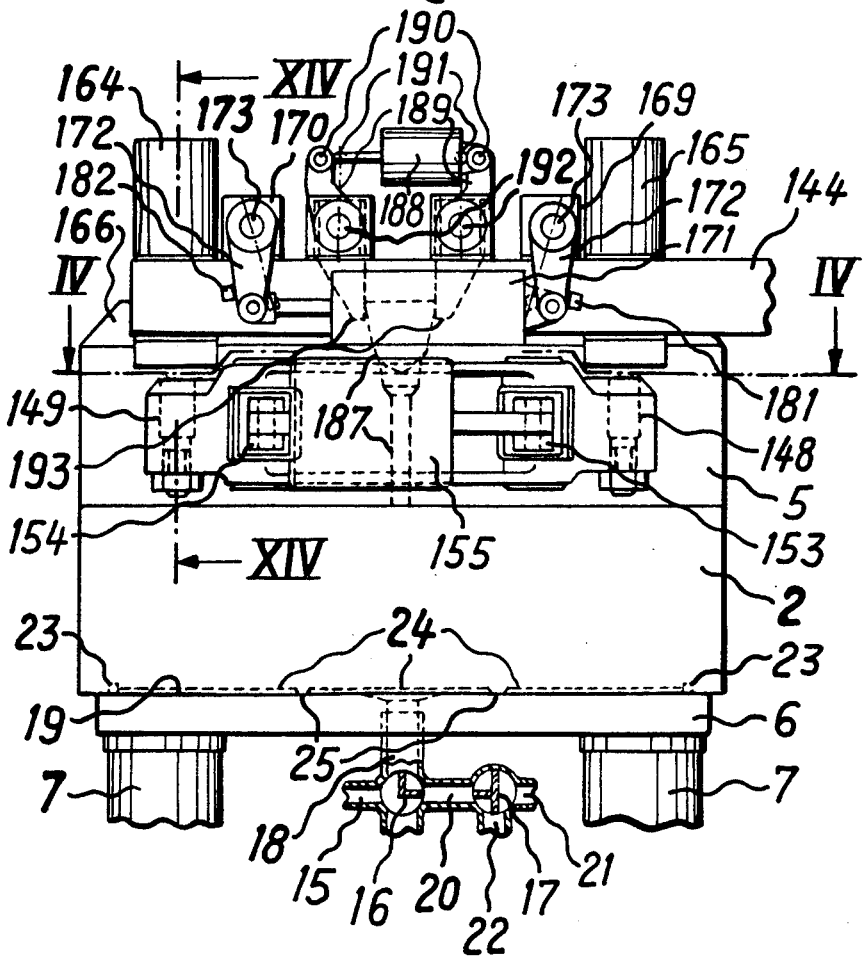
FIG. 5 is an elevational view of a portion of the mechanism shown in FIG. 4 and taken in the direction of B in FIG. 4.

In FIG. 1 a schematic arrangement of molding equipment is illustrated consisting of a molding machine 1, a pattern device 2 and a conveyor device 3 on which the pattern device can be moved from the position 4 into the molding machine and then back into the position 4. In FIG. 5, as well as in FIG. 1, a molded part 5 is shown positioned on the pattern device 2 which, in turn, bears on a support 6. The support 6 rests on columns 7 on a foundation, not shown, which preferably is separate from the foundation for the molding machine 1. A lifting and turning device 8 is located between and extends over conveyor 3 and another conveyor 9 positioned on a foundation 30, note FIG. 2, which is independent of the other devices. Mold boxes 10 are positioned on the conveyor 9 for movement in the direction of arrow 11 from an unpacking station (not shown) into a position 12 located under the device 8. However, the conveyor 9 can also be used to remove molded parts 4 in the direction of the arrow 13 after they have been moved from the pattern device onto the conveyor 9.

Figure 1A:
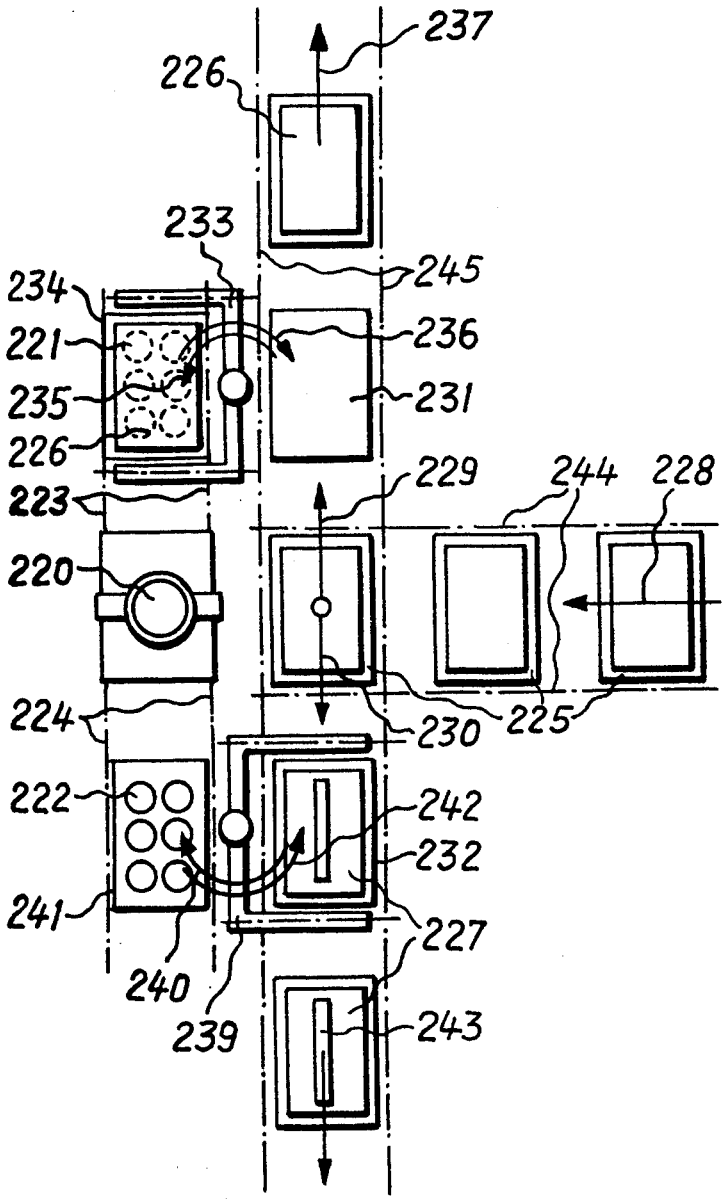
FIG. 1*a* is a schematic plan view of an equipment set up for molding parts similar to FIG. 1, but including two lifting and turning mechanisms, in accordance with the present invention, and conveyors for supplying and removing mold boxes and molded parts.

In FIG. 1*a* another schematic arrangement of molding equipment is shown, however, as distinguished from the arrangement shown in FIG. 1, it provides a molding machine 220 with pattern devices 221, 222 located on two of its opposite sides. Conveying devices 223, 224 provide support positions 234, 241, respectively, at the pattern devices from which mold boxes 225 can be moved in an alternating manner to the molding machine 220 and then returned to the support positions.

Mold boxes 225 move along the conveyor 244 in the direction of the arrow 228 to a conveying device 245 which runs transversely of the conveyor 244. From the position at which the mold boxes are received on the conveying device 245 they are moved in an alternating fashion in the directions of the arrows 229 and 230 into the positions 231, 232, respectively. Position 231 is located adjacent to pattern device 221 and position 232 is located adjacent to pattern device 222.

Molded parts 226 are produced in the pattern device 221 and molded parts 227 are formed in the pattern device 222.

A lifting and turning device 233, 239 is positioned between each of the pattern devices 221, 222 and the adjacent positions 231, 232, respectively, on the conveying device 245. Lifting and turning devices 233, 239 each has a "C" shaped frame as differentiated from the "H" shaped frame on the lifting and turning device 8 in FIG. 1. In FIG. 1*a* the frame of the device 233 is positioned over the pattern device 221 and, in addition to being movable in the vertical direction, it can turn or rotate in the directions of the arrows 235, 236 for moving mold boxes 225 between the position 231 on the conveying device 245 and the support position 234 on the conveying device 233 associated with the pattern device 221. The lifting and turning device 239 provides the same type of movement between the support position 241 and the position 232 on the conveying device 245 as does the device 233, and it is rotatable in the direction of the arrows 240, 242.

In using this arrangement illustrated in FIG. 1*a*, the mold boxes 225 are supplied in the direction of arrow 228 along the conveyor 244 to the conveying device 245. On the conveying device 245 the mold boxes are alternately moved to the positions 231 and 232. At position 231 the lifting and turning device 233 picks up a mold box and turns in the direction of arrow 235 over support position 234 where the mold box is lowered on the pattern device 221. After the mold box has been processed through the molding machine 220 and returned to the support position 234 the device 233 can pick up the molded part 226, move it in the direction of arrow 236, and set it down in position 231 on the conveying device 245.

At position 232 the mold box 225 undergoes the same processing operations as described above regarding position 231. The lifting and turning device 239 moves between position 232 and support position 241 in the direction of the arrows 240, 242. After the molded part 227 has been moved from the molding machine 220 to the position 232 it is transported in the direction of arrow 243 along the conveying device 245.

The movement of the conveying device 245 is coordinated to provide movement of the mold boxes to the pattern devices and then transport of the molded parts from the pattern devices.

The structure and operation of the lifting and turning devices 232, 239 including their "C" shaped frames, is similar to that of the lifting and turning device 8 and its "H" shaped frame which is described subsequently. In effect, the "C" shaped frame is half of an "H" frame. Further, to increase output the "H" shaped frame on the lifting and turning device 8 could be used on the lifting and turning devices 233, 239.

Figure 15A:
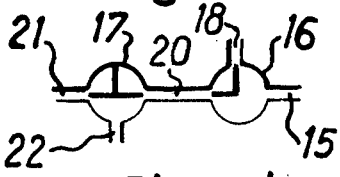
FIGS. 15*a*, 15*b* and 15*c* each contain a schematic illustration of a portion of the equipment shown in FIG. 5.
Figure 15B:
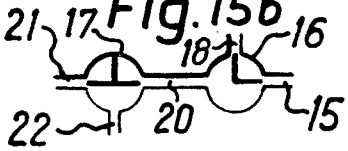
Figure 15C:
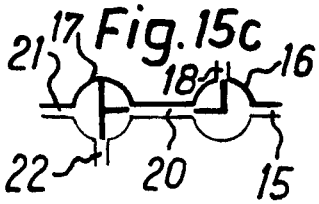

In FIG. 5 and in the schematic representations of FIGS. 15*a*, 15*b* and 15*c*, a compressed air line 15 is connected to a controllable angle check valve 16 and a controllable 3-way valve 17 is connected over a line 20 to the check valve. Further, an exhaust line 21 is connected to the 3-way valve and the connecting line 22 extends between the 3-way valve and a vacuum tank (not shown). This arrangement of valves and lines operates in the following manner:

Normally, the check valve 16 and the 3-way valve 17 are set as shown in FIG. 15*a* so that the line 18 extending to the support 6 is connected via check valve 16 and connecting line 20 with the exhaust line 21 with atmospheric conditions present in the line 18. If a pattern device 2 with a molded part 5 and the other parts thereon is moved from the molding machine 1 into position 4, the check valve 16 is positioned, as shown in FIG. 15*b*, so that compressed air is applied to the upper side 19 of support 6 with the upper side being cleaned before the pattern device is attached to it. Immediately after the cleaning operation, the upper side 19 of the support 6 is connected with the vacuum tank (not shown) by positioning the check valve 16 and the 3-way valve 17 as shown in FIG. 15*c* as the pattern device is lowered onto the support 6 and presses downwardly on the support. Packing 23 is provided on the undersurface of the pattern device 2 and effects a seal with the upper side 19 of the support. The undersurface of the pattern device is provided with recesses or gaps 24 separated by supporting surfaces 25. However, the present invention is not limited to the arrangement of the support 6 as shown in the drawing, this arrangement is shown by way of example. Support 6 can also be cleaned by brushes or strippers attached to the pattern device before the pattern device is placed in contact with the support 6. Furthermore, the pattern device 2, if it is low in weight, can be retained on the support by means of clamps when a molded part 5 is lifted off the pattern device 2.

Figures 2, 2A:
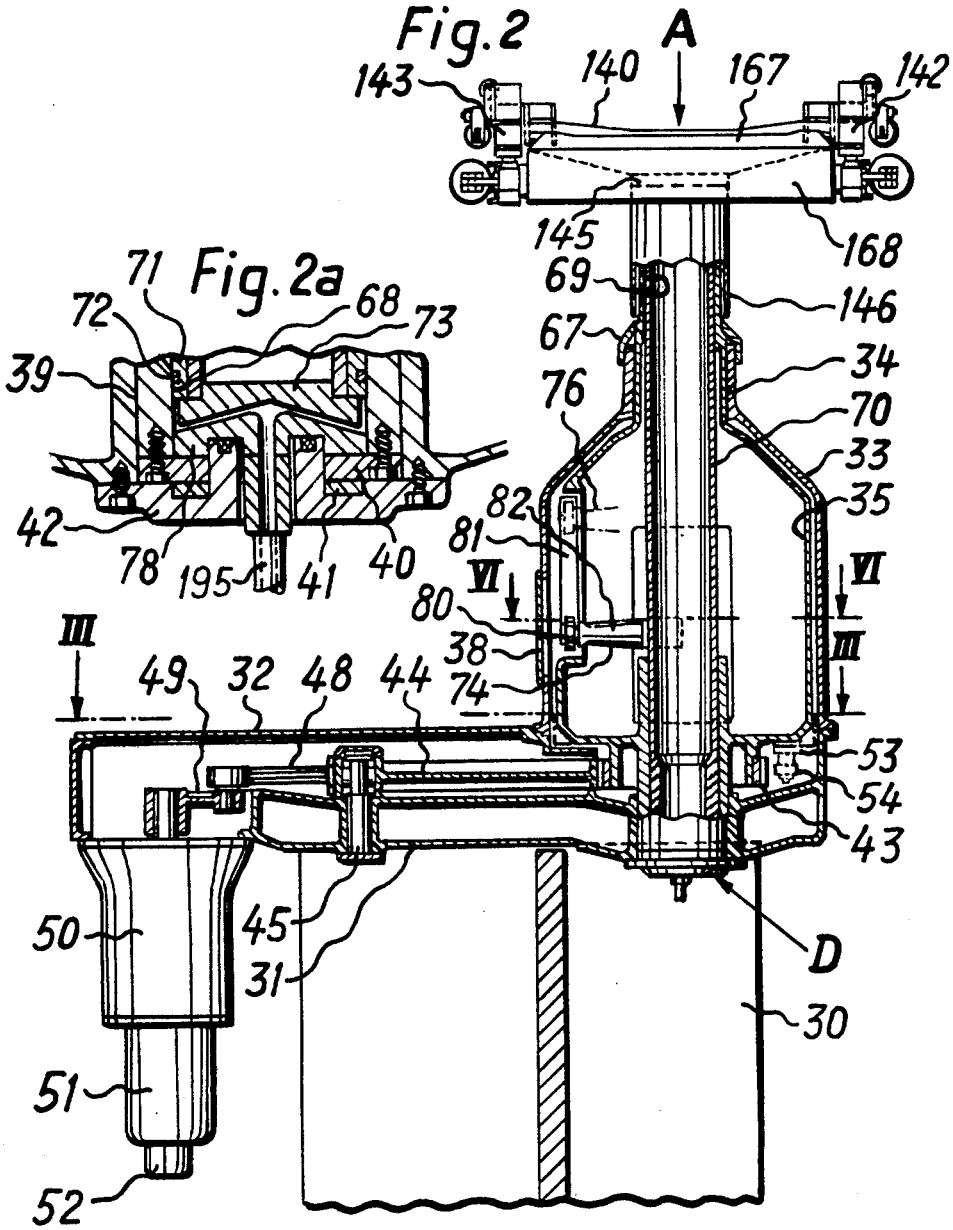
FIG. 2 is a vertical sectional view of the lifting and turning mechanism taken along line II—II in FIG. 3.
FIG. 2*a* is an enlarged partial section view of the mechanism illustrated in FIG. 2 and designated by the reference character D.
Figure 3:
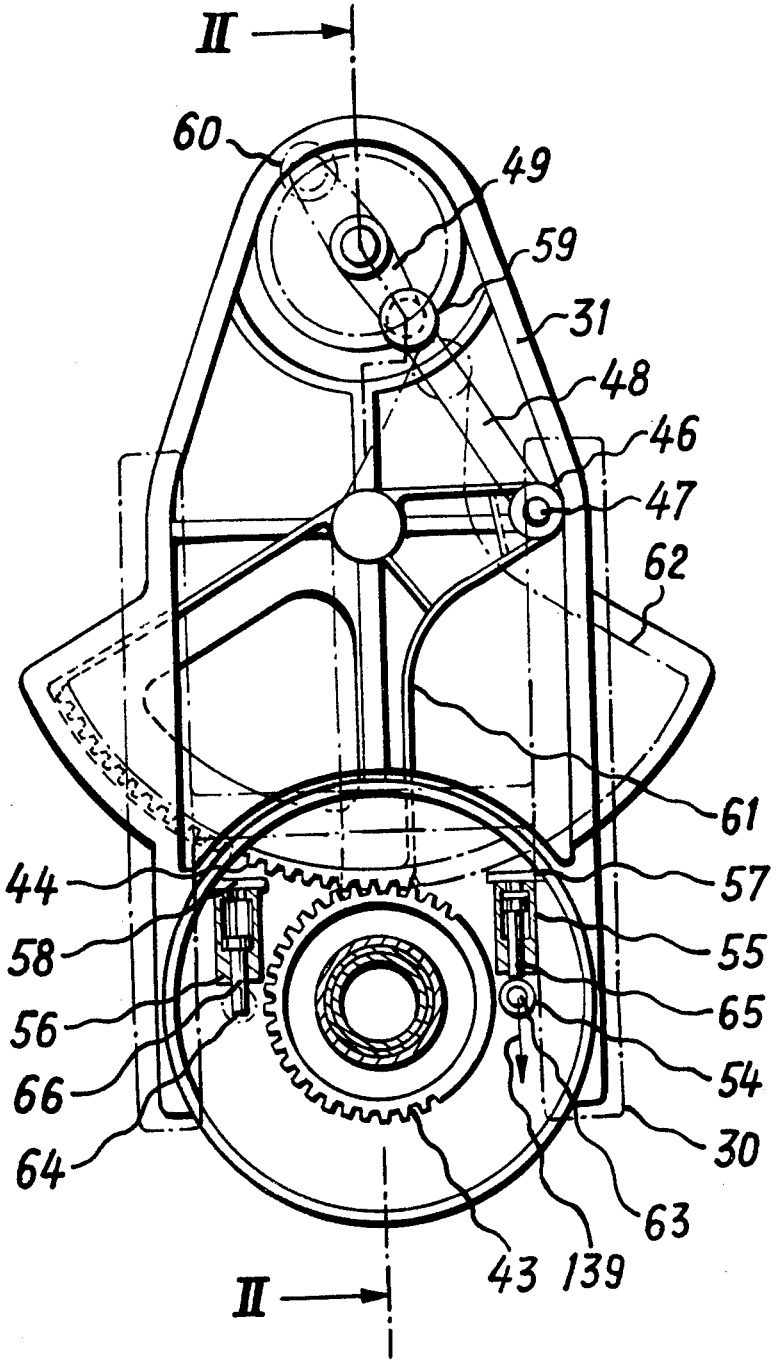
FIG. 3 is a top view, partly in section, of the drive for the turning mechanism taken along line III—III in FIG. 2 with the cover 32 removed.
Figure 6:
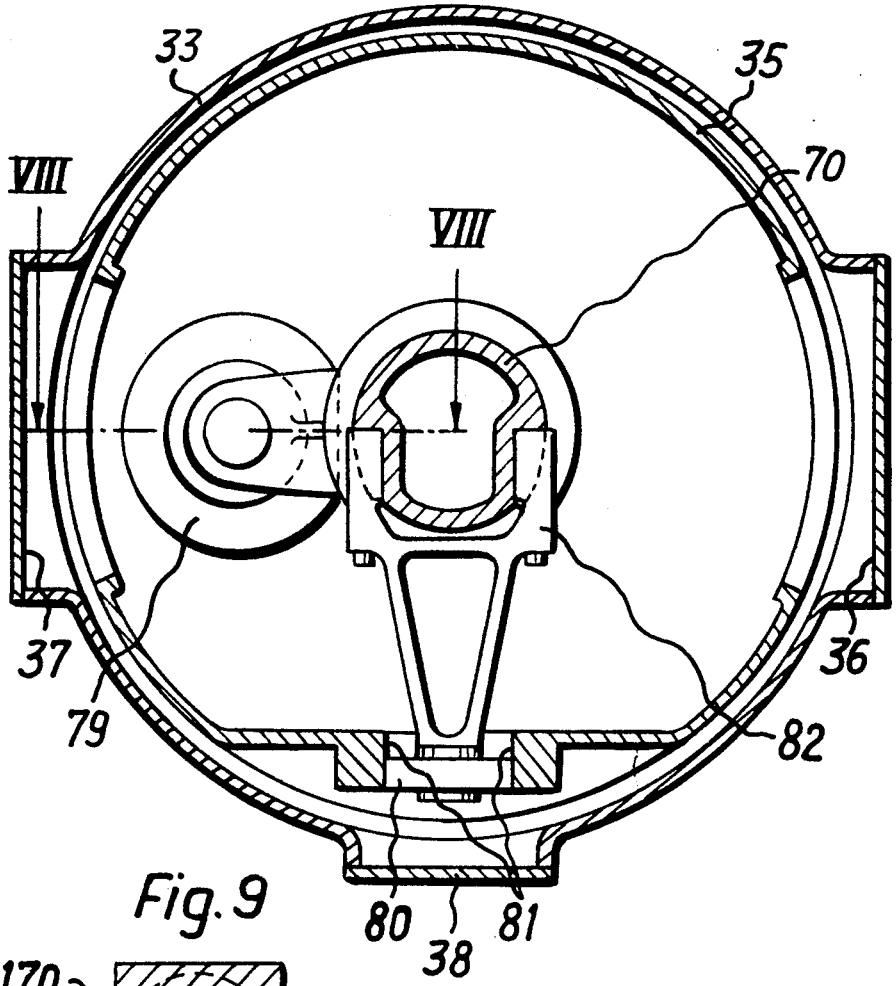
FIG. 6 is a horizontal sectional view taken along the line VI—VI in FIG. 2.

In FIGS. 2 and 3, the foundation 30 provides the support for the lifting and turning device 8. A housing 31, partly covered by a cover member 32, carries an upwardly extending housing part 33 rigidly connected to the housing. The housing part 33, note also FIG. 6, has openings which are closed in a dustproof manner by covers 36, 37 and 38. Within the housing part 33, a rotary member 35 is mounted on bearings 34, 39. The rotary member 35 is rigidly connected with a cover 40 which bears on a race 41 in cover 42 which is rigidly secured to the housing 31. A horizontally disposed gear wheel 43, note FIGS. 2 and 3, is secured to the rotary part 35 and is in meshed engagement with a toothed segment 44 mounted in a known manner on a journal 45. The toothed segment 44 has a lug 46 attached via a bolt 47 and a connecting rod 48 to a crank 49 of a motor gear 50. A motor 51 and a brake 52 are connected to the motor gear. Positioned on the rotary member 35 is a bolt 53 which carries a roller 54. A compressed air cylinder 55 is rigidly attached to a housing flange 57 and another compressed air cylinder 56 is similarly attached to another housing flange 58. The housing flanges 57, 58 are attached to the housing 31 and are spaced apart about the housing. When crank 49 turns from position 59, shown in full line in FIG. 3 to position 60, shown in broken line in FIG. 3, the toothed segment moves from position 61, shown in full lines, to position 62 shown in broken lines and moves the roller 54, secured onto the rotary member 35, from position 63, shown in full lines, into position 64 shown in broken lines. At the commencement of the rotation of the rotary member 35, roller 54 and connecting rod 65 of the compressed air cylinder 55, which is under constant pressure in the direction of the arrow 139 over the stroke of the compressed air cylinder 55, constantly presses the rod 65 against roller 54 and, thus, relieves the drive of the turning mechanism. Toward the completion of the rotary movement, roller 54 contacts and presses piston rod 66 of the compressed air cylinder 56 into the cylinder, and a part of the kinetic energy of the rotary member 35 and of the parts connected to it is taken up by the rod 66 and, thus, relieves the rotary drive toward the end of the rotation operation. Since both of the compressed air cylinders 55, 56 are under constant pressure they eliminate the entire motor clearance in the positions 63, 64 of the roller 54. Other members can be used in place of the compressed air cylinders 55, 56, for example, air springs or wire springs. However, the compressed air cylinders have the advantage that the piston pressure remains constant over the entire path, in contrast to the springs.

As can be noted in FIG. 2, the rotary member 35 has a two-part sealing ring 67 which is attached to the part and prevents the penetration of dust into the bearing 34. Vertically extending and aligned bores 68, 69 guide the vertically arranged tubular member 70. Member 70 has a piston 71 and piston rings 72 at its lower end, note FIG. 2*a*. Piston 71 is secured against displacement by a cover 73 secured on member 70. Member 70 is displaceable from a lower position 74, 75, note FIGS. 2 and 8, into an upper position 76, 77. In the lower position 74, 75, the weight of member 70 as well as that of the parts connected to its, bears on cover 73, cover 78, cover 40 and race 41 of cover 42, which is rigidly connected with the housing 31. The vertical movement of the member 70 is limited between its upper and lower positions by a damper 79, described below. Member 70 is rigidly connected with a beam 82 on which a roller 80 is supported and the roller is guided in a guide 81 and secures member 70 against rotation in any lifted position relative to the rotary part 35 in which the guide 81 is formed.

Figure 8:
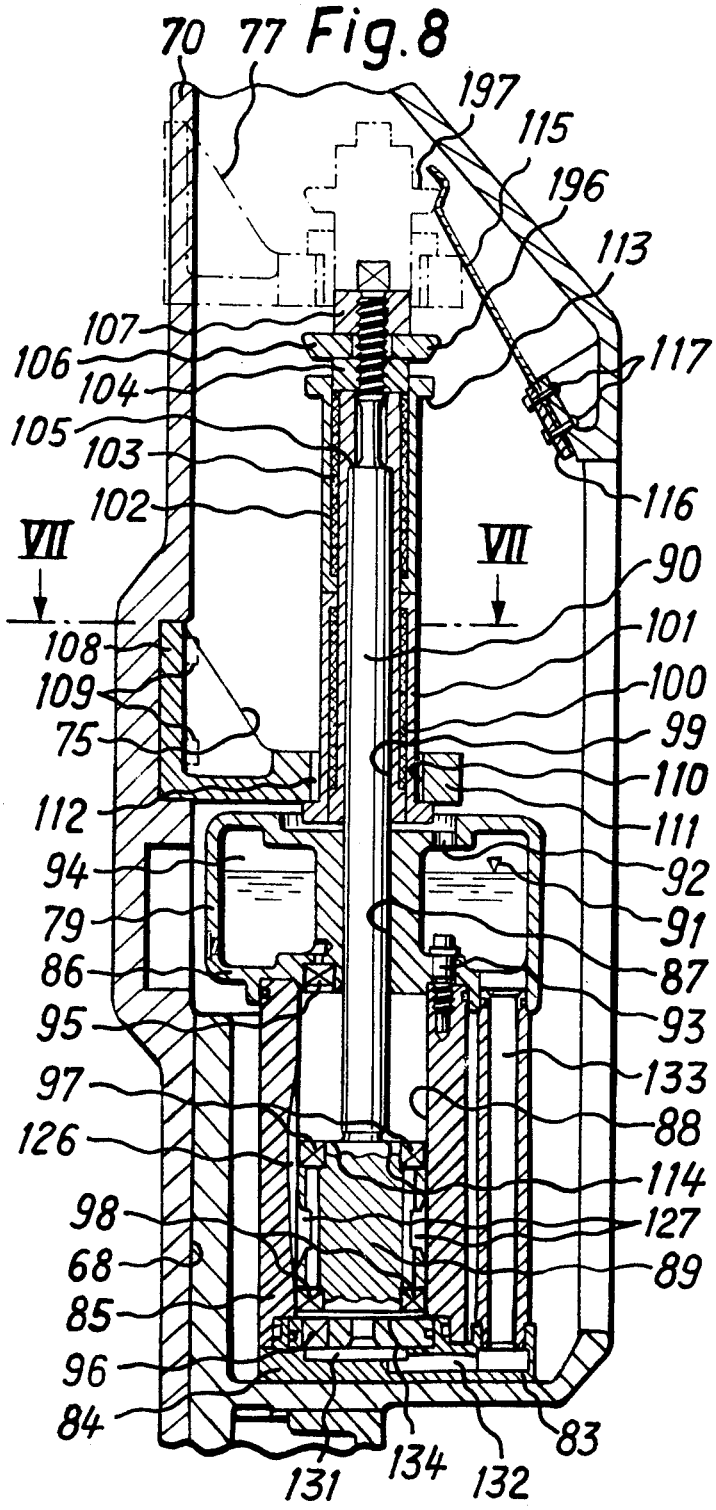
FIG. 8 is a sectional view taken along the line VIII—VIII in FIG. 6.
Figure 10:
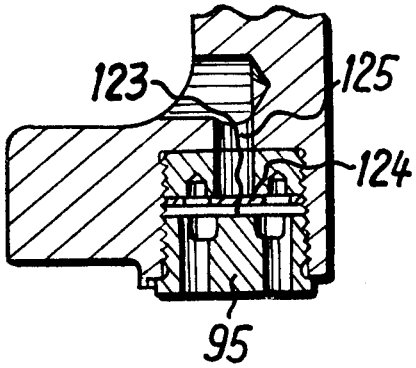
FIG. 10 is an enlarged detail view of the portion of FIG. 8 identified by reference numeral 95.
Figure 11:
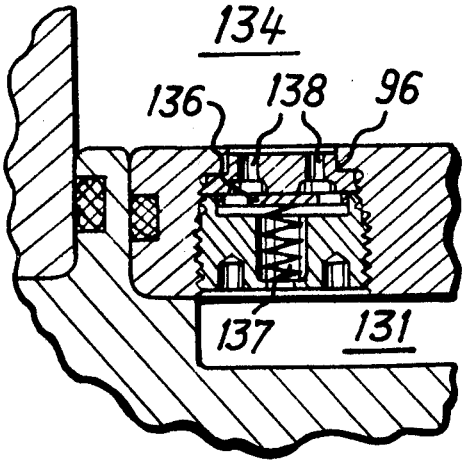
FIG. 11 is an enlarged detail view of the portion of FIG. 8 identified by the reference numeral 96.
Figure 12:
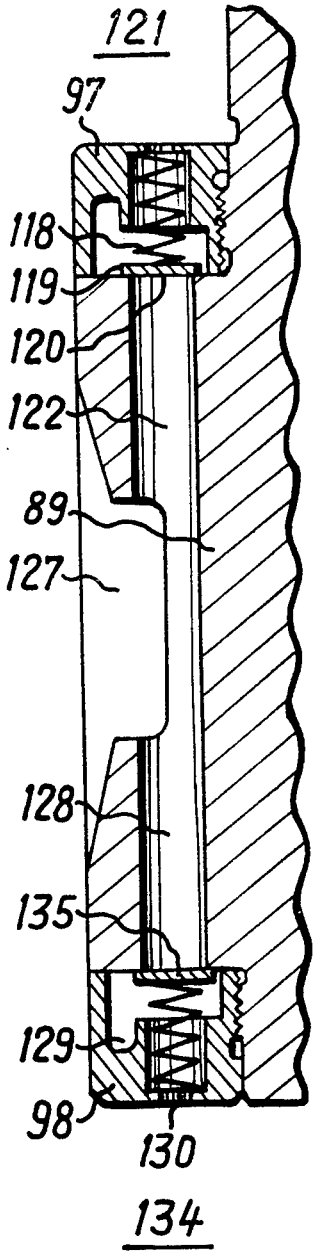
FIG. 12 is an enlarged sectional view of a portion of FIG. 8 identified by the reference numerals 97, 98.

As can be seen best in FIG. 8, the damper 79 is secured on a surface 83 to the rotary members 35. The damper 79 consists of a base plate 84, a vertically extending cylinder 85 projecting upwardly from the base plate, a cover 86 forming a closure for the upper end of the cylinder so that the combination of the base plate, cylinder and cover form an oil or hydraulic vessel. The cover 86 has a bore or guide 87 extending upwardly through it. The base plate 84, cylinder 85 and cover 86 are rigidly connected to one another and sealed in a known manner. The interior of cylinder 85 forms a bore 88 in which a piston 89 is vertically displaceable. A piston rod 90 is connected to the upper end of the piston 89 and extends outwardly from the cylinder through guide 87 in the cover 86. As shown in FIG. 8, the damper 79 is an annular vessel filled with hydraulic fluid up to a level 91 with bores 92 arranged so that fastening screws 93, extending through the cover 86 into the walls of the cylinder 85, can be tightened or loosened and, at the same time, permit the flow of air between the space 94 above the level 91 and the space surrounding the exterior of the damper. Valve 95 in FIG. 10, valve 96 in FIG. 11, and valves 97 and 98 in FIG. 12 are represented on an enlarged scale. The design and operation of these valves is described below.

A bush 99 laterally encloses the piston rod 90 above the damper 79 and a damping body 100 encircles a lower portion of the bush. Another bush 101 is located about the bush 99 outwardly of the damping body and extends upwardly for a portion of the height of the bush 99. Still another bush 102 extends upwardly from the upper end of the bush 101 spaced radially outwardly from the upper end of the piston rod 90 with a damping body 103 located between the bush 102 and the inner bush 99. A nut 104 is threaded onto the upper end of the piston rod 90 and secures the bush 99, damping body 100, bush 101, bush 102, and damping body 103 against a shoulder 105 on the piston rod 90. An annular disk 106 is secured against the upper surface of the nut 104 by a check nut 107.

Just above the damper 79 in FIG. 8 is a support 108 secured to member 70 by screws 109 and extending outwardly with a flange 111 having a bore 110 encircling the bush 101 so that the flange 111 can move with the support over the exterior of the structure enclosing the upper portion of the piston rod 90. In position 75, the bore 110 in flange 111 of support 108 laterally surrounds the piston rod 90 immediately above the damper 79. When member 70 moves downwardly from the position 77 of the support 108, the lower surface of the flange 111 bears against the surface 112 which extends radially outwardly at the lower end of the bush 101. As the flange 111 contacts the surface 112, it presses the piston 89 downwardly from the upper position it assumes with the piston rod 90 until it reaches the position shown in full lines in FIG. 8. Position 75 of the support 108 in FIG. 8 is identical to position 74 shown in FIG. 2 and the member 70 is in its lower position with its cover 73 bearing on the cover 78. If member 70 is lifted from position 75 into position 77, as the support moves upwardly around the piston rod 90, the flange 111 finally comes into contact with the surface 113 on the lower surface of intermediate disk 106 and lifts the piston rod 90 and piston 89 into position 77 indicated by broken lines until the upper face 114 on the piston bears against the oppositely disposed face of the cover 86.

When member 70 moves downwardly from position 77 to position 75, piston 89 and the parts connected to it tend to follow the lowering movement. To prevent the downward movement of the piston 89, a flat spring 115 is secured to the rotary member 35 by means of a pressure plate 116 and screws 117. In the position 77 of the piston 89-piston rod 90 the flat spring 115 bears against the surface of the intermediate disk 106 and holds the piston-piston rod in the upper raised position until the flange 111 on the support 108 contacts the surface 112. Such contact causes the flat spring 115 to release the intermediate disk so that the piston-piston rod commences its downward movement. The flat spring 115 provides a lock which insures the satisfactory operation of the damper during the lowering movement.

When the piston 89-piston rod 90 rises upwardly from position 75 represented in solid lines into the position 77 represented in broken lines, spring 118, note FIG. 12, presses valve disk 119 against the surface 120 and prevents the fluid contained in space 121 from flowing through bore 22. At the same time, valve disk 123, note FIG. 10, bearing on surface 124 prevents the hydraulic fluid from flowing from space 121 through bore 125. Accordingly, the hydraulic fluid is forced to flow through channel 126 which diminishes in its cross section with the square of the stroke of the piston 89. Member 70 is braked with a constant force as soon as flange 111 contacts the lower surface 113 of the upper end of bush 102, until it reaches the position 77. Position 77 is secured by contact of the piston face 114 bearing against the downwardly facing surface of the cover 86. During the lifting movement the hydraulic fluid can flow undisturbed from space 127 through bore 128, channels 129, and bore 130 into space 134, since the valve disk 135 is lifted by the flow of the hydraulic fluid. Since the annular surface defining space 121 is smaller than the full circular surface defining space 134, hydraulic fluid flows at the same time during the lifting movement from space 94 through channels 133, 132 and space 131 then through bores 137, 138 into the space 134.

If part 70 moves downwardly from position 77 into position 75, piston 89-piston rod 90 is held by flat spring 115 in the position 77 until the flange 111 on the support 108 contacts the surface 112. Subsequently, as the piston 89 is lowered, valve disk 135 closes bore 128 and valve disk 136 closes bore 137. Therefore, the hydraulic fluid in space 134 is forced to flow from the space 134 into space 137 through channel 126, whose cross section narrows with the square of the lowering movement of piston 89. At the same time the hydraulic fluid can flow out from space 121 and the small amount of excess hydraulic fluid obtained during the stroke can flow off through bore 125 into space 94 by slightly lifting valve disk 123. An advantage of damper 79 is that the downward movement has displaced a larger amount of oil than the lifting movement and, thus, partly balances the accelerating effect of the weight of the downwardly moving parts relative to the decelerating effect during the lifting movement.

At its upper end, member 70 is rigidly connected via a flange 145 with a beam 140 and beams 141 and 144 extend transversely of the member 70 from one side of beam 140 while beams 142 and 143 extend transversely of the part 70 from the other side of the beam 140. Beams 140–144 are designed as bending-torsion-resistant hollow bodies having a rectangular cross section. Member 70 is secured to a protective pipe 146 which protects bore 69 against fouling and moves upwardly and downwardly with the member 70.

Figure 14:
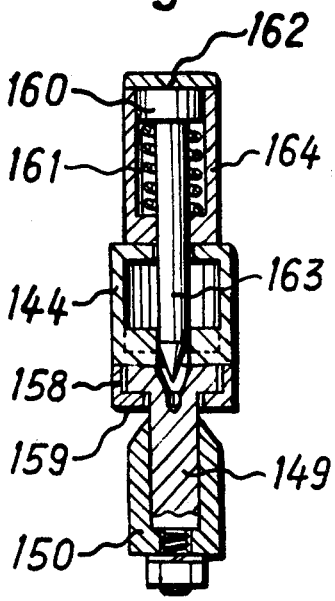
FIG. 14 is a sectional view taken along the line XIV—XIV in FIG. 5 and through the bolt 149 shown in FIG. 4.
Figure 4:
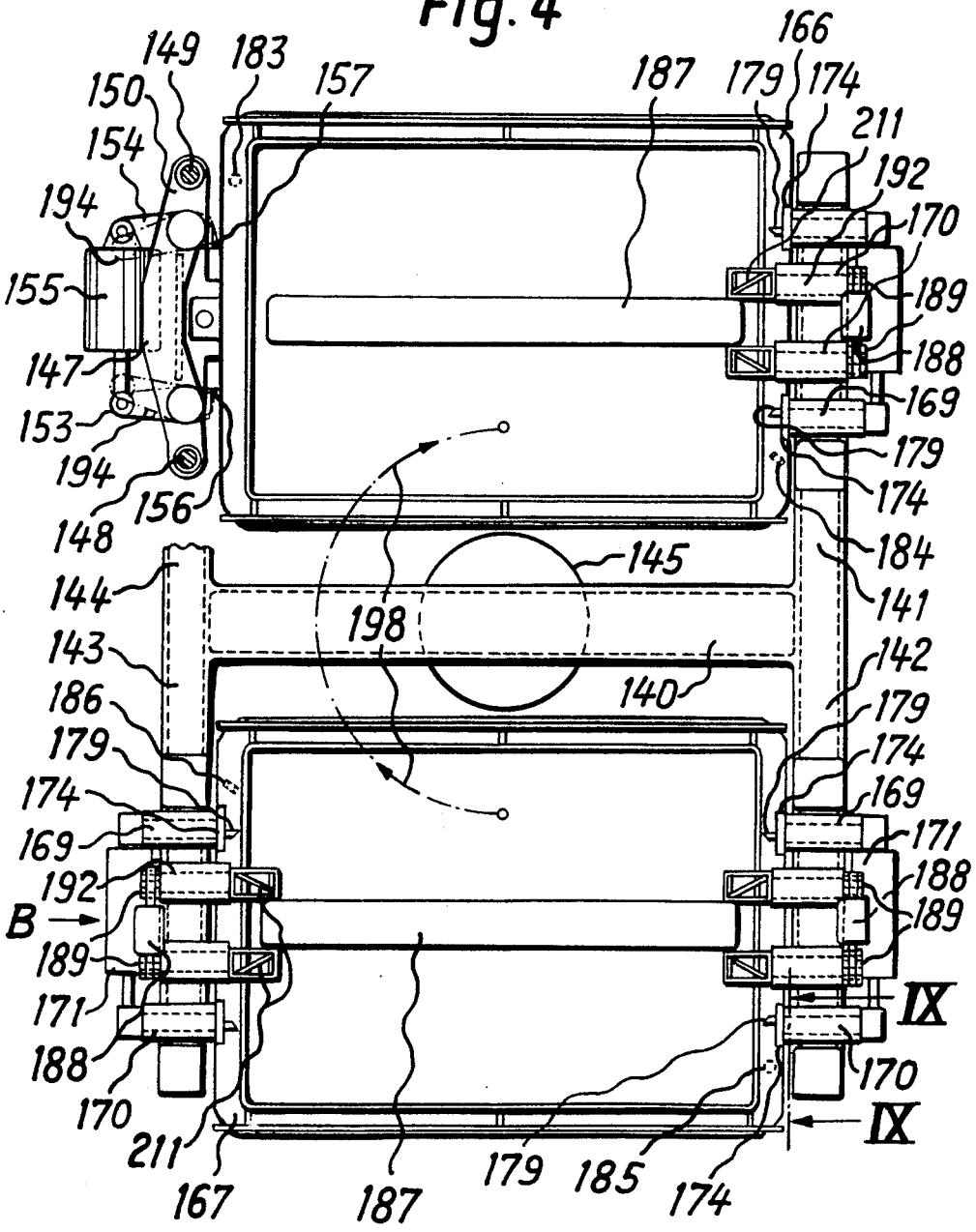
FIG. 4 is a partial top view, taken in the direction A in FIG. 2 of the top part of the elevating mechanism taken along the line IV—IV in FIG. 5 with a portion of the elevating mechanism removed for illustrating the means for engaging a mold box.

FIGS. 2, 4 and 5 show the structure used for clamping the mold boxes or the mold parts. For clarity's sake, in FIG. 4 beam 144 is cut away and in FIG. 5 the parts secured on the top side are cut off along the line IV—IV. In FIG. 4, a clamping device 147 is provided for engaging a mold box or a molded part. The clamping device is arranged on beam 141, 142 and 143 as well as on beam 144, however, for clarity's sake they are not shown on all the beams. The clamping device corresponds to that disclosed in Swiss Pat. No. 308,042. In many years of use, the clamping device has proved to be excellent. The clamping device is mounted vertically on beam 144 free from play, but horizontally displaceable by bolts 148, 149 which are rigidly connected to the part 150 which extends between the two bolts. This particular type of support is illustrated in FIG. 14 which displays a section through bolt 149 along the line XIV—XIV of FIG. 5. As mentioned, bolt 149 is rigidly connected with part 150. Two double-levers 153–154 are connected to the part 150. These levers are pressed in a known manner against the surfaces 156, 157 of the mold box or of the molded part by means of a controllable cylinder 155. Since the manner in which the molded part 5 or the mold box 6 are retained is already known from Swiss Pat. No. 308,042, a detailed description is not provided here.

Figure 9:
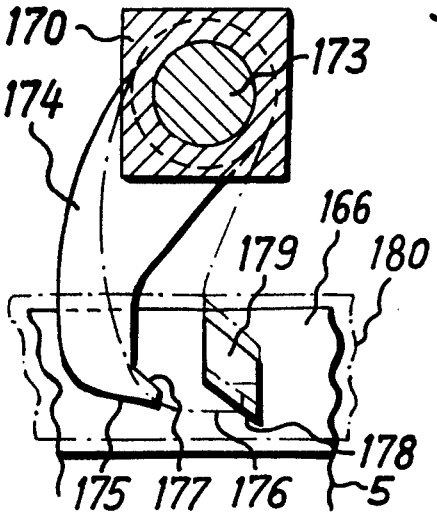
FIG. 9 is a sectional view taken along the line IX—IX in FIG. 4.
Figure 7:
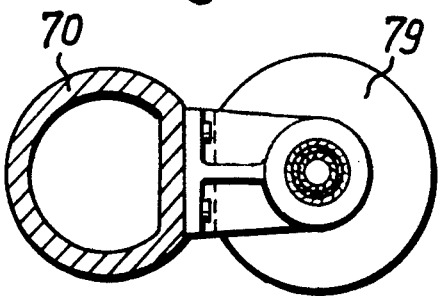
FIG. 7 is a sectional view taken along the line VII—VII in FIG. 8.

Bolts 148, 149, note FIGS. 5 and 14, can be moved horizontally according to the clearances 158, 159 as long as the pistons 160 of the cylinders 164, 165 are lifted by spring 161 into position 162. If the cylinders 164, 165 receive compressed air in a known manner, the pistons 160 and the piston rods 163 connected to them are moved downwardly toward the bolts 148, 149 and secure a predetermined center position of the bolts. Preferably the center position of bolt 148 is secured by doweling the mold box on a pattern device with round dowels while flat dowels are used for the position of bolt 149. The present invention has the advantage, as can be seen in FIGS. 4, 5 and 14, that the clamping device 147 is held extremely rigidly against torsion bending in the position secured by the piston rods 163, while they are easily displaceable in all directions of the lifted positions of the piston rods 163. Therefore, the invention permits, in contrast to known devices, a design of the beams 140– 144, as described above, as torsion-bending resistant tubular members of rectangular cross section. The means for engaging and releasing the mold boxes and molded parts are not confined to double-levers and to clamps. These molding devices can also be designed to engage the bottom of the mold boxes or molded parts with specifically designed stops on the mold boxes or molded parts to prevent them from any horizontal displacement. In FIGS. 4, 5 and 9 clamping devices 169, 170 for lifting and engaging the frames 166, 167 are shown. The frames are attached on the molded part 5 or the mold box 168. A cylinder 171 is articulated to levers 172 which are connected by bolts 173 to levers 174. By operating the cylinders 177 the levers can be moved between the positions 175 and 176. In FIG. 9, the frame 166 is lowered onto the molded part 5. Frame 166 is released by the levers 174 which are in position 175. By actuating cylinder 171, lever 174 is moved from position 175 to position 176 and the face 177 on the lever contacts the face 178 on stop 179 rigidly fixed to the frame 166. It will be noted that the face 178 is disposed obliquely to the horizontal direction of the frame. The face 177 on the lever slides along the corresponding face 178 on the stop and lifts the frame 166 into the position 180 designated by broken lines. At the same time the levers clamp the frame 166. If cylinder 171 is operated so that the levers 174 move or open from position 176 to position 175, the levers 172 bear on stops 181, 182 which are connected to the beam 144. The stops 181, 182 establish the open position 175 of the levers 174 at a predetermined distance from stop 179. Frames 166, 167 are secured in position on the respective molded part 5 and mold box 10, 168 and are secured in the horizontal position by round dowels 183, 185 and flat dowels 184, 186. The dowel guides in the mold boxes and molded parts are designed in a manner not shown, so that molding sand can be emptied laterally to the outside. The solution according to the invention has the advantage that the frames 166, 167 can be easily and simultaneously exchanged when the patterns of the pattern device 2 are changed, if the pattern volume does not change substantially, that is, if the frame is adapted in its height and in its longitudinal profile to the changed patterns.

In FIGS. 4 and 5, a top sprue pattern 187 is illustrated in accordance with Swiss Pat. No. 320,832 or U.S. Patent Application Ser. No. 501,817 filed Aug. 29, 1974 by the present applicant. By actuating cylinder 188, the levers 189 can be moved from a positon 190 into another positon 191. The levers 189 are secured by bolts 192 to levers 193. In position 190, shown in FIG. 5, the levers 189 and the levers 193 engage the top sprue pattern 187 in a known manner. If the levers 189 are moved from position 190 into position 191, by actuating cylinders 188, the levers 193 release the top sprue pattern 187. The ends of the bolts 192, to the extent that they project over the inner surfaces of the mold box in plan view, note 211 in FIG. 4, are designed as vertical flat sections forming a rectangle which is stiffened by a vertical diagonally extending flat section, so that sand falling through during the filling of the mold is not deflected. In accordance with the present invention, it is possible to lift all parts to be attached on a pattern device, which parts must be removed again after the molded parts are compressed.

Figure 13:
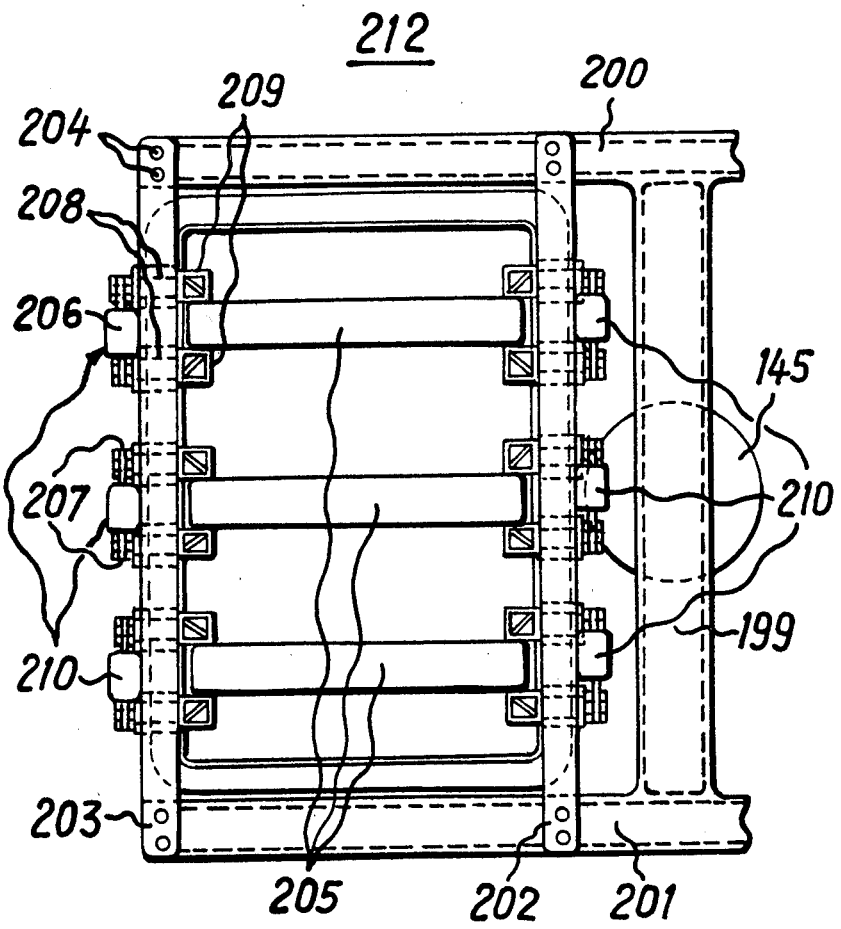
FIG. 13 is a plan view taken in the direction of the arrow A in FIG. 2 of another embodiment of the part illustrated.

In the embodiment of the invention illustrated in FIG. 13, used when large molds with several upper sprues 205 are produced and the upper sprues, as is customary, extend transversely of the longitudinal direction of the molded part 212. For the sake of clarity, FIG. 13 shows only means for gripping and releasing parts of the pattern device. The means for engaging and releasing of the mold boxes, molded parts and frames correspond to those shown in FIGS. 4, 5 and 14.

The beams 199, 200 and 201 are connected by the flange 145 with member 70, as described above. Beams 202 and 203 are attached on the beams 200, 201 and extend in generally parallel relation with the beam 199. Screws 204 secure the beams 202 and 203 to beams 200, 201. This arrangement is necessary because the beams 202, 203 are located directly above the attached frame. The means for engaging and releasing the top sprue pattern 205 attached on the pattern device, that is, cylinder 206, lever 207, bolt 208, and lever 209, are identical in their arrangement and operation with the parts 188–193 shown in FIG. 5.

The lifting and turning or rotating mechanism 8 of the molding equipment embodying the invention, operates in the following manner:

A finished, compressed molded part 5 is located in position 4 on the pattern device 2 resting on support 6, note FIG. 5. Frame 166 bears on the molded part 5 and top sprue pattern is attached in a known manner on the pattern device 2. In addition, a mold box 10 rests on the conveyor device 9 opposite the position 4. Member 70 and its connected parts are in the lowered position 74, 75. The clamping devices associated with the molded part for engaging and releasing the molded part, for engaging frame 166 and for engaging top sprue pattern 187 which are connected with the beams 141 and 144, are in the open positions 194, 175 and 191, respectively, note FIGS. 5 and 9. The clamping devices 147 connected with the beams 142 and 143, note FIG. 4, are in the open position 194. The clamping device for engaging frame 167, connected with the beams 142 and 143, holds frame 167 in the clamped position 176 and 180, respectively, note FIG. 9. The means for clamping top sprue pattern 187 hold it in the lever position 190, according to FIG. 5.

By reversing cylinders 155, 171 and 188, the clamping means connected with means 141 and 144 engage the molded part 5 and the associated frame 166, lifting it as well as top sprue pattern 187 into position 180, note FIG. 9. At the same time, by reversing cylinders 155 associated with beams 142, 143, the mold box 168 is also engaged. Line 195, note FIG. *2a*, is provided with compressed air through the valve, not shown. The lifting member 70 and the parts connected with it, hence also the molded part, frame 166, top sprue pattern 187, mold box 10, 168, frame 167 and its top sprue pattern are lifted from position 74, 75 into position 76, 77. When member 70 has been lifted until flange 111 on support 108 contacts the face 113 on the bush 102 encircling the upper end of the piston rod 90, the piston rod and piston 89 are lifted. When flange 111 contacts the face 113, the damping body 103 contracts and thus prevents flange 111 and face 113 from being damaged. When the flange 111 contacts face 113, it lifts the bush 102 with the parts connected to it, hence also the piston 89 of the damper 79 which moves from the position 196 shown in full lines to position 197 shown in broken lines, decelerating with a constant force the lifting velocity of the parts connected with member 70 through the distance between the two positions 196, 197 and finally stopping the member 70 and the parts with it in the position 197 which corresponds to positions 76, 77. In position 197, flat spring 115 engages the intermediate disk 106 and secures the lifted position of the piston 89-piston rod 90. In this lifted position, the brake 52 is lifted. Motor 51 receives current and turns the crank 49 by means of the motor gear from position 59 to position 60. The toothed segment moves from position 61 into position 62 and thus rotates the rotary member 35 via gear wheel 43 from position 63 in the direction of arrow 39 into position 64. Beam 140 and the beams 141-144 connected to it as well as the mold box 10, 168, frame 166 and sprue pattern 187 are turned in the direction of arrow 198, see FIG. 4. When crank 49 reaches position 60, the electric current to the motor is cut off in a known manner over a control and the brake is placed in operation again.

Lifting member 70 and parts connected with it are then lowered from position 76, 77 into position 74, 75. During the lowering movement, the cylinders 171 on the beams 142, 143 are reversed and the levers associated therewith are moved from positon 176 into position 175. Frame 167 moves from the lifted position 180 on the mold box and is centered on the mold box by the round dowel 185 and the flat dowel 186. When the flange 111 moving downwardly with the lifting member 70 contacts the face 112 at the lower end of bush 101, the damping body 100 contracts at first and prevents flange 111 and face 112 from being damaged and moves the parts connected with bush 101, hence the piston 89 and piston rod 90 of the damper rod, from position 197 into position 196 braking the lowering movement in the above-described manner. When cover 73 contacts cover 79, member 70 and the parts connected with it stop in the lowered position 74. By reversing cylinders 155, beams 141 and 144 and double-levers 153 and 154 move into position 194 and release the molded part which rests on the conveyor device 9. At the same time, both the double levers 153, 154 and the levers 193 for retaining top sprue pattern 187 are opened by reversing the cylinders 155 and 188 associated with beam 142, 143 thus releasing the mold box 10 on the pattern device 2 with its frame 167 and top sprue pattern 187 attached to the pattern device. The reversal of the valve in line 195 effect the lifting of member 70 from position 74 into positon 76 while the mold box 10, 168 and frame 167 attached to it, as well as the top sprue pattern 187, remain on the pattern device 2. At the same time the molded part remains on conveyor device 9, frame 166 and top sprue pattern 187 are held in the clamping means connected with the beams 142 and 143 and, as a result, are lifted with the member 70.

In known molding equipment the mold box attached on the pattern device with its associated parts is filled with molding sand, the 3-way valve 17 and the angle check valve 16 are moved from the position in FIG. 15*c* into the position in FIG. 1 15*a* so that the line 18 and the gap 24 are at zero pressure. The mold box 10 on the pattern device 2 now filled with molding sand, is subsequently compressed to the molded part and returned with the pattern device positioned over the support 6. At the same time, the molded parts 14 and the mold boxes 10 on the conveyor 9 are moved in the direction of the arrow 13 and a new mold box 10 is moved into position 12. Shortly before the pattern device 2 and the parts associated with it are lowered, as described above, the top surface 19 of support 6 is cleaned with compressed air.

While a specific embodiment of the invention has been shown and described in detail to illustrate the application of the inventive principles, it will be understood that the invention may be embodied otherwise without departing from such principles.

What is claimed is:

1. A device for moving items to and from different positions in a production operation, such as in a molding operation, comprising an upwardly extending member, a first support mounted on and extending transversely of said member with said first support extending outwardly from at least one side of said member, first means mounted on said first support for releasably engaging items to be moved, second means operatively associated with said member for moving said member upwardly and downwardly and for affording controlled deceleration of said member at the end of the upward and downward movement, and third means operatively associated with said member for rotating said member about a vertical axis and for controlling the acceleration and stopping of the rotational movement of said member, said first means comprising clamps arranged to be moved between released and clamped positions, each of said clamps including a mounting consisting of a part having therein a pair of vertically arranged bolts positioned in horizontally spaced relation, each said bolt being horizontally displaceable within a given limit, each said bolt having an axially extending recess therein, and a rod-like member inwardly tapered toward one end which is engageable within the recess in said bolt for securing said bolt in a predetermined horizontal position.

2. A device, as set forth in claim 1, wherein said rod-like member comprises a piston rod having a piston at one end and engageable at the other end with the recess in said bolt, a piston chamber enclosing said piston, a spring action on said piston within said chamber and biasing said piston rod into the disengaged position relative to the recess in said bolt.

3. A device, as set forth in claim 1, wherein said first support comprises a frame located on and extending outwardly from one side of said upwardly extending member, said frame arranged to be attached to the items to be lifted and moved, stops attached to said frame, said first means includes first levers and first controllable means operatively connected to said first levers for moving said first levers between a first postion engageable with said stop for lifting said frame and a second position in spaced relation to said stops.

4. A device, as set forth in claim 3, wherein said stops each have a face engageable with one of said first levers with the surface of said face directed downwardly and disposed at an acute angle to the horizontal, the surface of said first lever is engageable with said surface of said face being arranged to slide in contacting engagement with said surface of said face for initially displacing said frame slightly upwardly before gripping engagement is achieved.

5. A device, as set forth in claim 4, wherein said first means includes second levers and second controllable means in operative engagement with said second levers for moving said second levers from a first position in engagement with an item within said frame and a second positition spaced relation from the item.

6. A device, as set forth in claim 1, wherein said support comprises a pair of frames each located on an opposite side of said upwardly extending member, said frames arranged to be attached to the items to be lifted and moved, stops attached to said frames, said first means includes first levers and first controllable means operatively connected to said first levers for moving said first levers between a first position engageable with said stop for lifting said frames and a second position in spaced relation to said stops.

7. A device, as set forth in claim 6, wherein said stops each have a face engageable with one of said first levers with the surface of said face directed downwardly and disposed at an acute to the horizontal, the surface of said first lever is engageable with said surface of said face being arranged to slide in contacting engagement with said surface of said face for initially displacing said frame slightly upwardly before gripping engagement is achieved.

8. A device, as set forth in claim 7, wherein said first means includes second levers and second controllable means in operative engagement with said second levers for moving said second levers from a first position in engagement with an item within said frame and a second position in spaced relation from the item.

9. A device, as set forth in claim 1, wherein said upwardly extending member comprises a first piston rod having a first piston at one end thereof, a housing laterally enclosing at least a portion of the axial length of said piston rod including said piston, a rotary part located within said housing and laterally surrounding said first piston rod, a gear wheel connected to said rotary part, said third means comprises a toothed segment in meshed engagement with said gear wheel, a motor, a gear drivingly connected to said motor, a crank attached to said motor gear and connected to said toothed segment so that as said motor is operated it drives said toothed segment which rotates said member through 180° via said gear wheel.

10. A device, as set forth in claim 9, wherein said upwardly extending member is rotatable through 180° between a first position and a second position, said third means includes a pair of compressed air cylinders connected to said housing, a roller attached to said rotary part, each of said cylinders having a connecting rod extending therefrom and exerting a force tangential to said rotary part, in the first position one of said connecting rods is in contact with said roller and said roller moves with said rotary part as it rotates from the first to the second position so that said roller contacted by said one of said connecting rods in the first position bears against the other one of said connecting rods in the second position.

11. A device, as set forth in claim 1, wherein a second support for supporting an item to be moved extends laterally from said upwardly extending member so that said first support is positioned above said second support, and means for retaining items on said second support.

12. A device, as set forth in claim 1, wherein a second support for supporting an item to be moved extends laterally from said upwardly extending so that said first support is positioned above said second support, a duct having a first end connected to said second support and a second end spaced from said first end, an angle check valve located at the second end of said duct, a compressed air line connected to said check valve, a first connecting line attached to said check valve, a 3-way valve connected to the opposite end of said connecting line from said check valve, a second connecting line attached to said 3-way valve at one end and arranged for connection to a vacuum source at its other end so that by controlling said check valve and 3-way valve said duct connected to said second support can be supplied with one of compressed air, vacuum conditions and atmospheric conditions.

13. A device for moving items to and from different positions in a production operation, such as in a molding operation, comprising an upwardly extending member, a first support mounted on and extending transversely of said member with said first support extending outwardly from at least one side of said member, first means mounted on said first support for releasably engaging items to be moved, second means operatively associated with said member for moving said member upwardly and downwardly and for affording controlled deceleration of said member at the end of the upward and downward movement, and third means operatively associated with said member for rotating said member about a vertical axis and for controlling the acceleration and stopping of the rotational movement of said member, said member including a first piston rod having a first piston at one end thereof, wall means forming a bore enclosing said first piston rod with said first piston rod arranged to move relative to said bore, a housing enclosing said wall means, said second means including a damper mounted on said first piston rod with said first piston rod being axially displaceable relative to said damper between a first position and a second position.

14. A device, as set forth in claim 13, wherein said damper comprises a chamber, a second piston rod having a second piston at one end thereof mounted within said chamber with said piston being axially displaceable within said chamber, said second piston rod projecting outwardly from said chamber, said second piston rod disposed in parallel relation with said first piston rod and spaced laterally from said first piston rod, a first annular plate secured to and extending laterally outwardly from said second piston rod at its end opposite said piston, which end is located outwardly from said chamber, a second annular plate secured to and extending laterally outwardly from said second piston rod closely spaced from said first annular plate and located on the opposite side of said first annular plate from said second piston, a second support secured to said first piston rod and extending laterally toward said second piston rod and located between the chamber and said first annular plate, said wall means includes an annular flange extending transversely of the axis of said second piston rod, said annular flange located between said first annular plate and said chamber, in the first position of said first piston rod said second support bears agasinst said annular flange and in moving into the second position moves away from said annular flange into contact with said first annular plate and said second piston of said second piston rod being axially displaceable within said chamber due to the contact of said second support with said first annular plate causing the other end of said second piston rod to move away from said chamber.

15. A device, as set forth in claim 14, wherein a spring is attached to said housing and extends into the path of movement of said second annular plate on said second piston rod, said spring arranged to engage said second annular plate and to hold said second piston rod from movement as said first piston rod and support thereon move from the second position to the first position so that when said support reaches the second position it biases said second piston rod against said spring releasing the holding engagement and permitting the other end of said second piston rod to move toward said chamber.

16. A device for moving items to and from different positions in a production operation, such as in a molding operation, comprising an upwardly extending member, a first support mounted on and extending transversely of said member with said first support extending outwardly from at least one side of said member, first means mounted on said first support for carrying items to be moved, second means operatively associated with said member for moving said member upwardly and downwardly and for affording controlled deceleration of said members at the end of the upward and downward movement, and third means operatively associated with said member for rotating said member about a vertical axis and for controlling the acceleration and stopping of the rotational movement of said member, said first means comprising clamps arranged to be moved between released and clamped positions to engage and disengage an item, each of said clamps comprising a carrier means secured to said first support so as to be horizontally displaceable within a given limit and locking means for locking said carrier means in a predetermined horizontal position relative said first support, to thereby allow horizontal displacement of an item engaged by said clamps relative to said first support together with said carrier means upon unlocking of said locking means and prior to such item being disengaged by said clamps.

17. A device for moving items to and from different positions in a production operation, such as in a molding operation, comprising an upwardly extending member, a first support mounted on and extending transversely of said member with said first support extending outwardly from at least one side of said member, first means mounted on said first support for carrying items to be moved, second means operatively associated with said member for moving said member upwardly and downwardly for affording controlled deceleration of said member at the end of the upward and downward movement, and third means operatively associated with said member for rotating said member about a vertical axis and for controlling the acceleration and stopping of the rotational movement of said member, said first means comprising a carrier means secured to said first support at a location removed from said upwardly extending member so as to be horizontally displaceable within a given limit, locking means operable between an unlocked and a locked condition to secure said carrier means in a predetermined position relative to said first support, when in said locked condition, and clamps carried by said carrier means arranged to be moved between released and clamped positions for engaging and disengaging an item, to thereby allow in the unlocked condition of said locking means horizontal displacement of an item engaged by said clamps together with said carrier means relative to said first support and to prevent in the locked condition of said locking means horizontal displacement of said carrier means out of said predetermined position.

* * * * *